United States Patent [19]

Viglione

[11] 4,439,289

[45] Mar. 27, 1984

[54] PROCESS FOR REMOVAL OF MAGNETIC COATINGS FROM COMPUTER MEMORY DISCS

[75] Inventor: Gaetano T. Viglione, Amesbury, Mass.

[73] Assignee: Sanders Associates, Inc., Nashua, N.H.

[21] Appl. No.: 280,738

[22] Filed: Jul. 6, 1981

[51] Int. Cl.[3] ..... C25F 5/00; C23G 1/02; B29C 17/08; C09K 13/04

[52] U.S. Cl. ..... 204/146; 204/129.7; 204/129.75; 134/3; 134/28; 134/38; 156/668; 252/79.2

[58] Field of Search ..... 134/3, 38, 28; 156/668, 156/665, 637, 344; 252/79.4, 79.2; 204/146, 129.6, 129.7, 129.75, 129.8; 427/142

[56] References Cited

U.S. PATENT DOCUMENTS

| | | | |
|---|---|---|---|
| 2,840,521 | 6/1958 | Wasserman | 204/146 |
| 3,767,491 | 10/1973 | Chough | 252/79.4 X |
| 3,954,648 | 5/1976 | Belcak et al. | 134/38 X |
| 3,962,108 | 6/1976 | Perruccio | 134/38 X |
| 3,993,804 | 11/1976 | McCready et al. | 427/140 |
| 4,169,026 | 9/1979 | Kikuchi et al. | 204/129.75 X |
| 4,304,681 | 12/1981 | Martin et al. | 134/38 X |

*Primary Examiner*—Donald R. Valentine

*Attorney, Agent, or Firm*—Louis Etlinger; Richard I. Seligman

[57] ABSTRACT

Removal of magnetic coatings from computer memory discs is achieved by immersing the discs in a bath of a sulphuric-acid and glycerine solution while applying an electrical potential between electrodes in the bath, one of which is the disc itself. After removal of the disc from the sulphuric-acid glycerine solution, it is sequentially immersed in alcohol and then water; any remaining coating is next mechanically removed and then the disc is immersed in high purity water and dried.

18 Claims, 3 Drawing Figures

PROCESS FOR REMOVAL OF MAGNETIC COATINGS FROM COMPUTER MEMORY DISCS

BACKGROUND OF THE INVENTION

This invention relates to magnetic discs and, more particularly, to removing of magnetic coatings therefrom.

A large quantity of magnetic discs are currently being used in computer systems. These discs are used to store data at very high bit densities and must be extremely reliable in that the loss of even a few bits during computer use cannot be tolerated. Thus, the standards and specifications to which the discs are manufactured are highly rigid. During manufacture an aluminum blank disc is coated with a magnetic coating (iron oxide plus binder) and baked. Small minor defects in the coating is generally a cause for rejection and scrapping of the disc. To avoid scrapping discs which have been rejected due to defective coatings, one method used is to remove the defective coating by mechanical abrasion (grinding and honing). This procedure however results in partial destruction of the original surface of the disc in that part of the aluminum base is removed. The disc cannot then be used for its original purpose. Since the blanks cost five or more dollars each the loss due to defective coatings can be substantial.

Accordingly, it is an object of the present invention to provide an improved method for processing defective magnetic discs.

It is another object of this invention to provide an improved method for processing magnetic discs to remove the magnetic coating therefrom.

It is a further object of this invention to provide a method for processing magnetic discs to remove the magnetic coating therefrom without damaging the metal substrate.

SUMMARY OF THE INVENTION

Briefly, in one embodiment of the invention discs having a defective magnetic coating thereon are immersed in a solution of sulphuric acid and glycerine while an electrical potential is applied between electrodes in the solution, one of the electrodes being the disc itself. The disc is kept in the solution a sufficient amount of time until the binder is destroyed or digested leaving the iron oxide loosely adhered to the aluminum base. The disc is then removed from the sulfuric acid-glycerine solution and immersed in an alcohol bath for a short period of time.

In the next step of the process the disc is removed from the alcohol bath and immersed in water to remove the alcohol reaction product. At this point in time most of the magnetic coating will have been removed from the disc. After removal from the water, the remaining coating is readily mechanically removed using a soft brush or water spray.

The disc is then immersed in distilled water to remove any salts which could cause spotting of the disc, and finally dried using, for example, a hot air blower. These operations remove the iron oxide coating and binder without affecting the aluminum substrate and, therefore, provide a substrate suitable for recoating.

BRIEF DESCRIPTION OF THE DRAWINGS

The above-mentioned and other features and objects of this invention will become more apparent by reference to the following description taken in conjunction with the accompanying drawings, in which.

DESCRIPTION OF PREFERRED EMBODIMENTS

Figure 1:
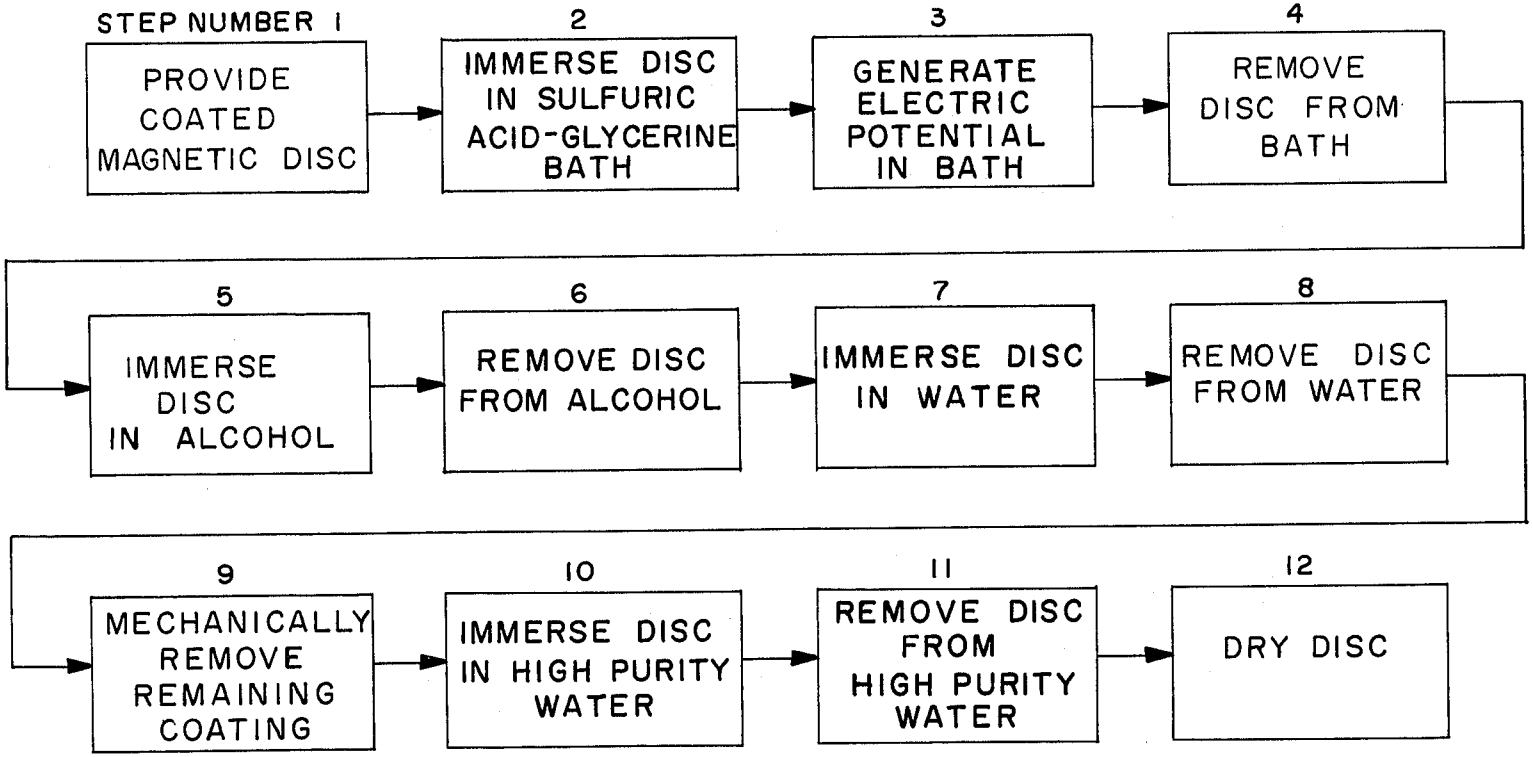
FIG. 1 is a flow diagram of the process used in removing magnetic coatings from computer memory discs.
Figure 2:
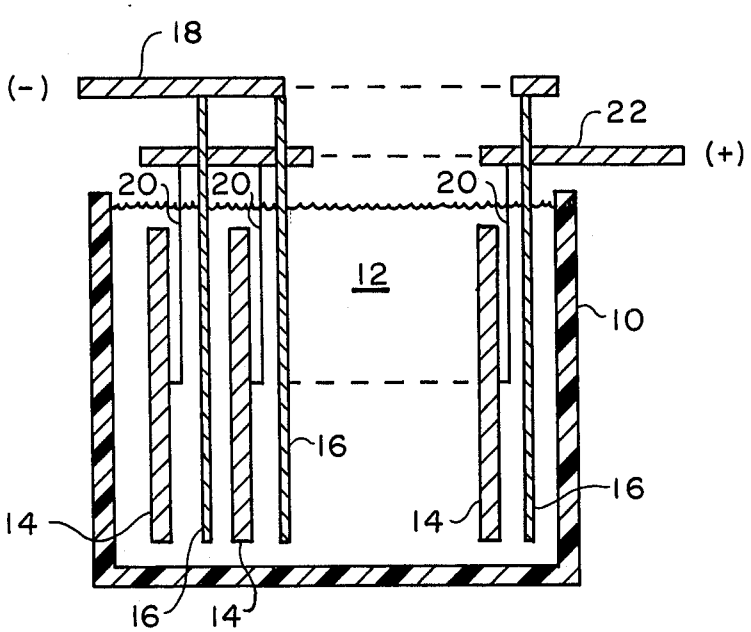
FIG. 2 is a cross-sectional view illustrating the tank for immersing discs in the sulphuric acid-glycerine bath showing the discs and manner of applying the electrical potential thereto.

Referring now to FIG. 1 of the drawings, there is illustrated thereby the process for removal of magnetic coatings from computer memory discs. The process is carried out by providing a coated magnetic disc (FIG. 1, step 1) from which the magnetic coating, generally comprising an iron oxide plus organic or plastic or resin binder, is to be removed. In step two of the process the disc is immersed in a sulphuric acid-glycerine bath. The glycerine acts as a wetting agent. An electric potential is applied in this bath (step 3). The equipment for providing the sulphuric acid-glycerine bath and generating the electric potential therein is illustrated in FIG. 2 of the drawings.

The equipment includes a tank 10 made of a material, such as plastic, which will resist any reaction with the contents of the bath. The tank 10 is filled with a solution 12 of sulphuric acid and glycerine. Preferably the sulphuric acid is on the order of 95 to 100 percent pure sulphuric acid. Although other percentages may be used as long as the percentage does not decrease to the point that the excessive water will cause a reaction to attack the aluminum disc. Glycerine is added to the solution at a ratio typically of 0.4 milliliters of glycerine per gallon of acid. Although sulphuric acid is the preferred acid for use in this process, other acids may be substituted which do not attack the aluminum disc such as nitric acid. A plurality of the magnetic discs 14 are immersed in the sulphuric acid-glycerine solution 12 in accordance with step 2.

Figure 3:
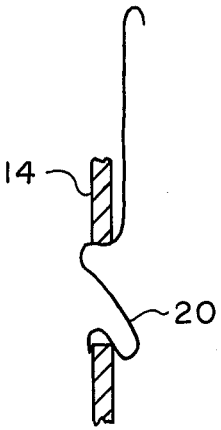
FIG. 3 is a cross-sectional view of a mechanism for maintaining the disc in the tank of FIG. 2.

In order to apply the electric potential per step 3 a number of electrodes 16 are positioned in the bath. These electrodes, which are preferably made of stainless steel, are attached to a negative bus 18. Members 20 are provided to maintain the disc 14 within the bath 12 and to supply a positive potential thereto from a positive bus 22. Members 20 are only schmatically illustrated in FIG. 2 and illustrated in greater detail in FIG. 3. As shown in FIG. 3, the actual configuration of the members 20 are such that they fit within the center hole of the disc and are held therein by a spring action of the member 20 with the top of the member 20 configured so as to hook onto the positive bus 22. Member 20 is preferably made of aluminum. The electrical potential is provided by applying a voltage between the positive and negative buses 22 and 18. Typically 15 volts dc has been used.

The discs 14 are permitted to remain in the bath 12 for an amount of time sufficient to cause destruction of the binder from the disc. It has been found that this destruction occurs with discs of certain manufacturers in about 10 to 20 minutes while discs of other manufacturers may require immersion for up to typically thirty minutes. The immersion time varies from manufacturer to manufacturer due to the different types of coatings used.

Most of the iron oxide is not removed from the disc during this time and only a small portion thereof accumulates in the sulphuric acid-glycerine solution. To enhance removal of the coating, ultrasonic energy may be applied to the acid-glycerine solution.

After the required immersion period the disc is removed from the acid-glycerine bath (step 4) and immersed in alcohol (step 5). While alcohol is the preferred solution other non-aqueous solutions may be used instead. Water cannot be used, of course, because it will react with the sulphuric acid such as to attack the aluminum substrate. Alcohol, on the other hand, reacts with the acid to neutralize it so it will not attack the aluminum and leaches the sulfonated binder. During this step additional portions of the coating will be removed from the disc. Ultrasonic energy may also be applied during this step of the process.

In step 6 the discs are removed from the alcohol and immersed in water (step 7). This step removes the alcohol reaction product. At this time most of the coating will be removed from the discs. Ultrasonic energy may also be applied during this step of the process. In step 8 the disc is removed from the water, and using a soft brush or a water spray the remaining coating is removed from the disc (step 9).

In step 10 the disc is immersed in a high purity water such as distilled or deionized water to remove any salts in the water which will contaminate the aluminum surface of the water (step 11) and dried (step 12).

While preferably all the steps of the process which have been described are carried out, it has been found that certain of them can be eliminated and yet still occasion removal of the coating from the disc. For example, if the electric potential is not applied the sulphuric acid-glycerine bath will still destroy the binder on the the disc. However, it will generally take much longer than when an electrical potential is used. There is, however, a greater risk of corroding, etching or pitting the aluminum substrate.

In an alternate embodiment of the invention a two-step process is employed for destroying the binder on the aluminum disc. In this embodiment prior to immersing the discs in the sulphuric acid-glycerine mixture, the discs are first immersed in a solution of stabilized hydrogen peroxide (50%) which is added and premixed with concentrated sulfuric acid and which is used as a digestive media. The hydrogen peroxide-acid mixture contains from 5 to 200 milliliters of hydrogen peroxide per gallon of acid. Hydrogen peroxide may also be added to the electrolytic bath. Thus, it is to be understood that the embodiments shown are to be regarded as illustrative only and that many variations and modifications can be made without the departing from the principles of the invention herein disclosed and defined by the appended claims.

I claim:

1. A method for removal of magnetic coatings, including a binder and metal oxide, from computer memory discs, comprising the steps of:

providing an acid solution which does not readily react with aluminum yet will cause disassociation of the binder from the disc substrate, said acid solution comprising sulfuric acid and a wetting agent; and immersing the discs in said solution.

2. The method of claim 1, wherein said wetting agent comprises glycerine.

3. The method of claim 1, further including the step of generating an electric potential in said solution.

4. A method for removal of magnetic coatings, including a binder and metal oxide, from computer memory discs, comprising the steps of:

providing an acid solution which does not readily react with aluminum yet will cause disassociation with the binder from the disc substrate, said acid solution comprising sulfuric acid; and immersing the discs in said solution.

5. The method of claim 4, wherein said acid solution is at least 95% sulfuric acid.

6. The method of claim 4, further including the step of generating an electrical potential in said solution.

7. A method for removal of magnetic coatings, including a binder and metal oxide, from computer memory discs, comprising the steps of:

providing an acid solution which does not readily react with aluminum yet will cause disassociation of the binder from the disc substrate, said acid solution comprising sulfuric acid and a wetting agent;

immersing the discs in said solution;

generating an electrical potential in said acid solution; and applying ultrasonic energy.

8. The method of claim 7, further including the step of immersing said discs in alcohol.

9. The method of claim 8, further including the step of immersing said discs in water.

10. The method of claim 9, further including the step of mechanically removing any remaining coating.

11. The method of claim 10, wherein said mechanically removing step includes the step of brushing said discs for removing any remaining coating therefrom.

12. The method of claim 10, wherein said mechanically removing step includes the step of spraying said discs with water to hydraulically remove any remaining coating therefrom.

13. The method of claim 11 or claim 12, further including the step of immersing said discs in high purity water.

14. The method of claim 13, further including the step of drying the discs.

15. A method for removal of magnetic coatings, including a binder and metal oxide, from computer memory discs, comprising the steps of:

providing a hydrogen peroxide-acid solution;

immersing the discs in said solution;

providing an acid solution which does not readily react with aluminum yet will cause disassociation with the binder from the disc substrate, said acid solution comprising sulfuric acid and a wetting agent; and immersing the discs in said acid solution.

16. The method of claim 15, wherein said hydrogen peroxide-acid solution is a hydrogen peroxide-sulfuric acid solution.

17. A method for removal of magnetic coatings, including a binder and metal oxide, from computer memory discs, comprising the steps of:

providing an acid solution which does not readily react with aluminum yet will cause disassociation of the binder from the disc substrate, said acid solution comprising sulfuric acid, a wetting agent and hydrogen peroxide; and immersing the discs in said solution.

18. The method of claim 17, further including the step of applying ultrasonic energy.

* * * * *